United States Patent [19]

Sakamoto et al.

[11] Patent Number: 5,027,782

[45] Date of Patent: Jul. 2, 1991

[54] FUEL CONTROL SYSTEM FOR AN AUTOMOBILE ENGINE

[75] Inventors: Katsuhiko Sakamoto, Hiroshima; Hiroshi Hirano, Hatsukaichi; Seiji Yashiki, Hiroshima, all of Japan

[73] Assignee: Mazda Motor Corporation, Hiroshima, Japan

[21] Appl. No.: 507,113

[22] Filed: Apr. 10, 1990

[30] Foreign Application Priority Data

Apr. 10, 1989 [JP] Japan ..... 1-93322

[51] Int. Cl.[5] ..... F02M 51/00

[52] U.S. Cl. ..... 123/492

[58] Field of Search ..... 123/492, 493, 434, 488

[56] References Cited

U.S. PATENT DOCUMENTS

| | | | |
|---|---|---|---|
| 4,886,030 | 12/1989 | Oba et al. | 123/488 |
| 4,893,602 | 1/1990 | Gross et al. | 123/492 |
| 4,896,644 | 1/1990 | Kato | 123/492 |
| 4,949,693 | 8/1990 | Sonoda | 123/492 |

*Primary Examiner*—Raymond A. Nelli

*Attorney, Agent, or Firm*—Wenderoth, Lind & Ponack

[57] ABSTRACT

A fuel control system for an automobile engine includes various sensors for detecting the running conditions of the engine, an injector or injectors for supplying fuel to the engine, and a control unit for reducing or cutting the amount of fuel to be supplied to the engine in response to the sensors at the time of deceleration and for controlling the injectors so that the amount of fuel to be supplied to the engine at the time of removal of deceleration is less than the normal amount corresponding to the running conditions of the engine. The control unit further operates so that the amount of reduction of the fuel supply is less in an engine equipped with an automatic transmission than in an engine equipped with a manual transmission. The control unit also operates so that the initial amount of fuel to be supplied to the engine at the time of removal of deceleration is less in the engine equipped with the manual transmission than in the engine equipped with the automatic transmission. In addition, the control unit can operate so that the rate of increase of fuel up to the normal amount after the removal of deceleration is less in the engine of the former type than in the engine of the latter type.

5 Claims, 2 Drawing Sheets

FUEL CONTROL SYSTEM FOR AN AUTOMOBILE ENGINE

BACKGROUND OF THE INVENTION

1. Field of the Invention

The present invention relates to a fuel control system for an automobile engine for controlling fuel supply so that fuel may be cut at the time of deceleration of the engine.

2. Description of the Prior Art

Japanese Patent Publication No. 58-20374 discloses a fuel control system for an automobile engine, in which when a throttle valve is fully closed and the engine speed is faster than a predetermined speed, the system judges that the engine is in an engine deceleration condition and cuts fuel supply to fuel injectors, thereby improving fuel consumption. When the deceleration condition is removed, the amount of fuel to be supplied to the engine is restored to an amount less than the normal amount corresponding to the running conditions of the engine at the time of removal of the deceleration condition. Thereafter, the amount of fuel to be supplied is gradually increased to the normal amount, and consequently, a sudden increase in the amount of fuel supply, which is caused by the restoration at the time of removal of the deceleration condition, is restored, thus preventing the occurrence of torque shock.

In an engine equipped with an automatic transmission, the engine output is transmitted to the transmission through a torque converter. Accordingly, such restoration in fuel supply causes less torque shock on a transmission output shaft in an engine equipped with an automatic transmission than in an engine equipped with a manual transmission.

Because of this, if the amount of the reduction of the fuel supply is established on the basis of the engine equipped with the manual transmission, the amount of the reduction is too great for the engine equipped with the automatic transmission, and therefore engine stalling occasionally takes place when a shift lever is shifted from the neutral position to the drive position. More specifically, if a driver is under the false impression that the shift lever is in the drive position while the shift lever is actually in the neutral position, he will probably step on an accelerator pedal to start and accelerate his car. In that event, the engine is brought into the so-called racing condition. When he confusedly operates the shift lever from the neutral position to the drive position, the engine speed rapidly decreases, thus occasionally resulting in stalling of the engine. One reason for this is that since the engine speed, that is a criterion for executing the reduction in supply fuel is generally higher in the neutral position than in the drive position, the reduction in fuel supply usually takes place when the shift lever is shifted to the drive position. In that event, if the amount of reduction fuel supply is too great, the rise of torque is dull. Another reason is that the load of the driving system acts on the engine.

On the other hand, if the amount of the reduction of the fuel supply is established set on the basis of the engine equipped with the automatic transmission, the amount of the reduction is too little for the engine equipped with the manual transmission. Accordingly, the torque shock acting on the transmission output shaft caused by the aforementioned restoration cannot be restrained.

SUMMARY OF THE INVENTION

Accordingly, the present invention has been developed to substantially eliminate the above-described disadvantage inherent in the prior art fuel control system for an automobile engine, and has as its essential object to provide an improved fuel control system capable of preventing torque shock at the time of deceleration of the engine and stalling of the engine at the time of shift of a shift lever.

In accomplishing this and other objects, the system according to the present invention includes running condition detecting means for detecting the running conditions of the engine, fuel supply means for supplying fuel to the engine, and fuel reduction or cut control means for reducing or cutting the supply of fuel to the engine at the time of deceleration in response to an output of the running condition detecting means and for controlling the fuel supply means so that the amount of fuel to be supplied to the engine at the time of removal of deceleration is rendered to be less than the normal amount corresponding to the running conditions of the engine. The system further includes control means for controlling operation so that the amount of the reduction of fuel reduced by the fuel cut control means is the less in an engine equipped with an automatic transmission than in an engine equipped with a manual transmission.

The control means further controls operation so that the initial amount of fuel to be supplied to the engine at the time of removal of deceleration is less in the engine equipped with the manual transmission than in the engine equipped with the automatic transmission.

In addition, the control means can control operation so that the rate of increase of fuel up to the normal amount after the removal of deceleration may be less in the engine of the former type than in the engine of the latter type.

In the above-described construction, the fuel cut control means controls the fuel supply means, on the basis of the running conditions of the engine detected by the running condition detecting means, so that fuel supply to the engine may be cut at the time of deceleration. Furthermore, the amount of fuel to be supplied to the engine at the time of removal of deceleration is rendered to be less than the normal amount corresponding to the running conditions of the engine. Accordingly, a sudden increase in the amount of fuel supply caused by restoration at the time of removal of deceleration can be restrained, thus preventing the occurrence of torque shock.

In addition, since the amount of the decrease of the fuel effected by the fuel cut control means is less in an engine equipped with an automatic transmission than in an engine equipped with a manual transmission, the function of preventing torque shock is fully achieved in the engine of the latter type whereas engine stalling is desirably prevented when the shift lever is shifted from the neutral position to the drive position in the engine of the former type.

BRIEF DESCRIPTION OF THE DRAWINGS

The above and other objects and features of the present invention will become more apparent from the following description taken in conjunction with preferred embodiment thereof with reference to the accompanying drawings, throughout which like parts are designated by like reference numerals, and wherein.

DETAILED DESCRIPTION OF THE PREFERRED EMBODIMENTS

Figure 1:
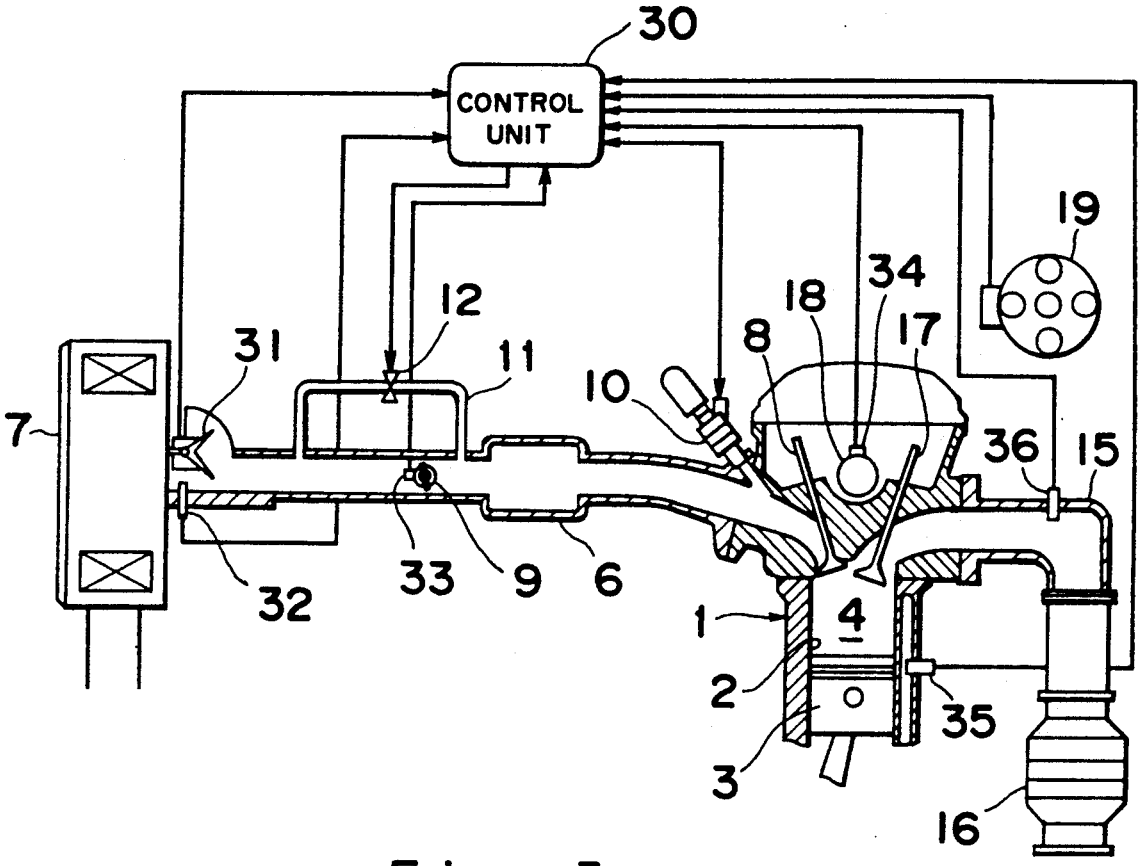
FIG. 1 is a schematic diagram of an automobile engine equipped with a fuel control system according to the present invention.

Referring now to the drawings, there is shown in FIG. 1 an automobile engine 1 equipped with a fuel control system according to the present invention. The engine 1 is provided with at least one cylinder 2 and at least one piston 3 freely reciprocally mounted in the cylinder 2. A combustion chamber 4 is defined by the cylinder 2 and the piston 3.

The combustion chamber 4 communicates with one end of an intake passage 6, the other end of which is open to atmosphere through an air cleaner 7. An intake valve 8 is reciprocally mounted on the engine 1 at a location where the intake passage 6 is open to the combustion chamber 4. A fuel injector 10 is fixedly mounted, as a fuel supply means for supplying fuel to the engine 1, in the intake passage 6 upstream from the intake valve 8. A throttle valve 9 for controlling the amount of intake air is pivotally mounted in the intake passage 6 upstream from the fuel injector 10. An idle speed control valve 12 is pivotally mounted in an idle speed control passage 11 bypassing the throttle valve 9.

The combustion chamber 4 further communicates with one end of an exhaust passage 15, the other end of which is open to atmosphere. An exhaust valve 17 is reciprocally mounted on the engine 1 at a location where the exhaust passage 15 is open to the combustion chamber 4. A catalytic converter 16 for purifying exhaust gas is provided in the exhaust passage 15. A camshaft 18 for driving the intake valve 8 and the exhaust valve 17 is rotatably mounted on the engine 1. A distributor 19 for controlling ignition timing is disposed in the vicinity of the engine 1. The injector 10 and the idle speed control valve 12 are electrically coupled with a control unit 30 so that the operation thereof may be controlled by the control unit 30.

Furthermore, an air flow sensor 31 for detecting the amount of intake air and an intake air temperature sensor 32 for detecting the temperature of the intake air are provided in the intake passage 6 upstream from the throttle valve 9. The opening of the throttle valve 9 is detected by a throttle sensor 33 connected thereto. The crank angle is detected by a crank angle detector sensor 34 mounted on the camshaft 18. The temperature of cooling water is detected by a cooling water temperature sensor 35 provided in a cooling water passage formed in the engine 1. The density of oxygen contained in exhaust gas is detected by an $O_2$ sensor 36 provided in the exhaust passage 15. Output signals from these sensors 31 to 36 are inputted into the control unit 30.

Figure 2:
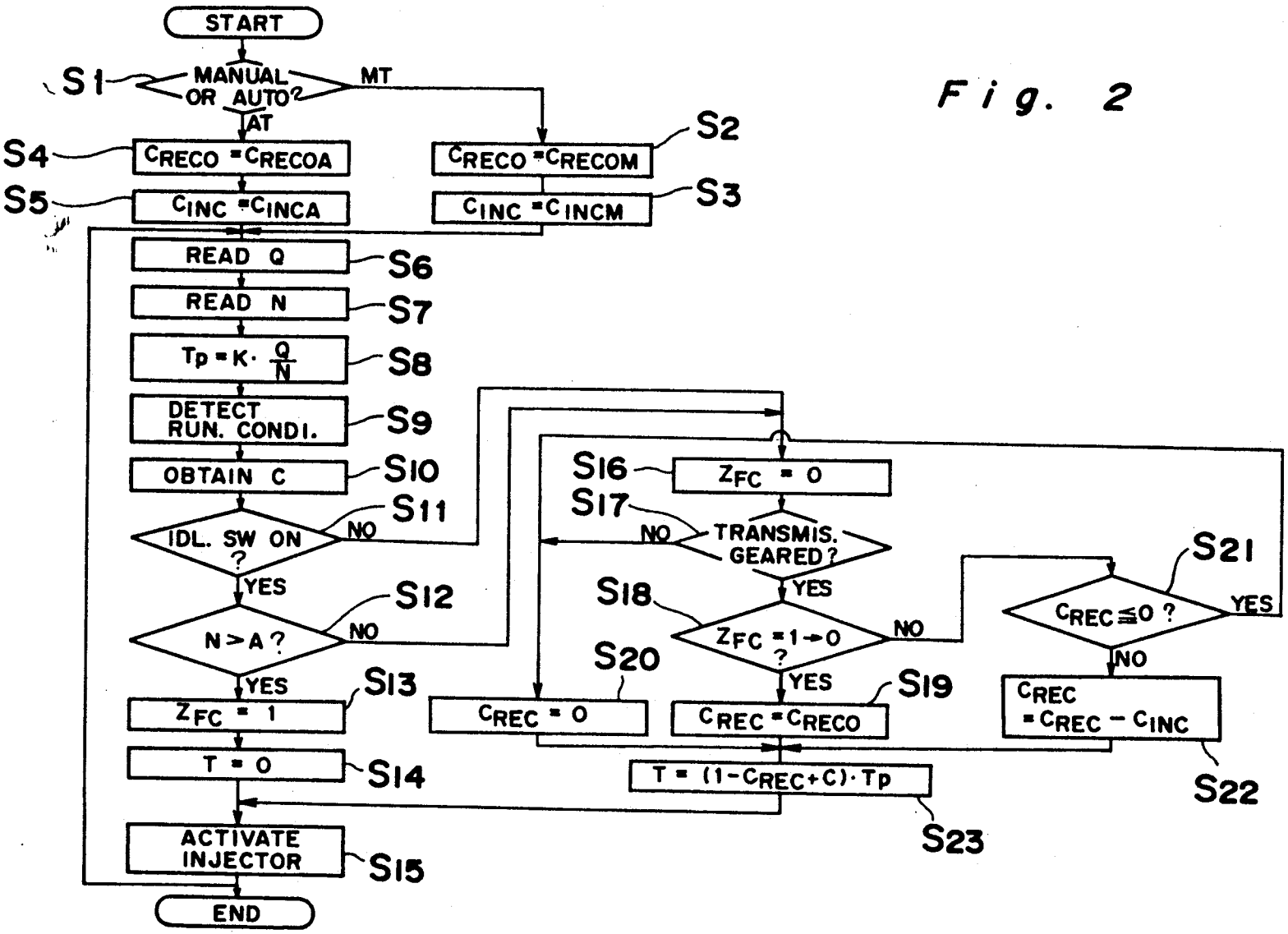
FIG. 2 is a flow chart indicative of the operation of the fuel control system as shown in FIG. 1.

The operation of the control unit 30 will be discussed hereinafter with reference to a flow chart of FIG. 2.

It is initially judged at step S1 whether the transmission is of the manual type or the automatic type. If the transmission is of the manual type, an initial fuel reduction constant $C_{RECOM}$ appropriate for the manual transmission is regarded as an initial fuel reduction constant $C_{RECO}$ at a time of restoration of fuel supply at step S2 followed by step S3 at which a rate of fuel increase $C_{INCM}$ appropriate for the manual transmission is set as a rate of fuel increase $C_{INC}$. In contrast, if the transmission is of the automatic type, an initial fuel reduction constant $C_{RECOA}$ appropriate for the automatic transmission is regarded as the initial fuel reduction constant $C_{RECO}$ at the time of restoration at step S4 followed by step S5 at which a rate of fuel increase $C_{INCA}$ appropriate for the automatic transmission is set as the rate of fuel increase $C_{INC}$.

Figure 3:
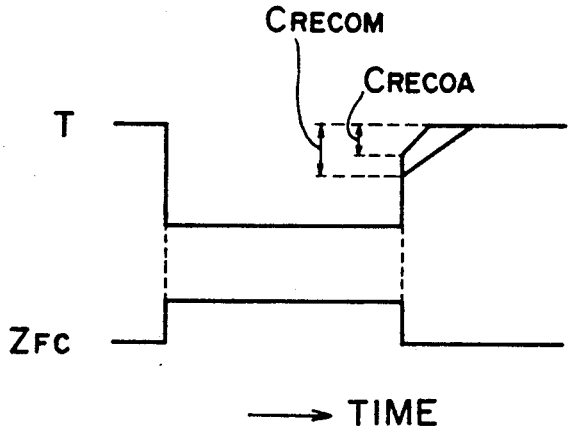
FIG. 3 is a time chart indicative of a fuel injection pulse width which changes with time.

As shown in FIG. 3, the initial fuel reduction constant $C_{RECO}$ corresponds to the amount of fuel reduced at the time of restoration i.e., the difference between the normal amount of fuel and the amount of fuel at the time of restoration. The initial fuel reduction constant $C_{RECOM}$ of the manual transmission is greater than the constant $C_{RECOA}$ of the automatic transmission. The rate of fuel increase $C_{INC}$ corresponds to the rate of increase of fuel from the amount of fuel immediately after restoration. The rate of fuel increase $C_{INCM}$ of the manual transmission is less than the rate $C_{INCA}$ of the automatic transmission.

Thereafter, the amount of intake air Q and the engine speed N are read at steps S6 and S7, respectively. At subsequent step S8, a basic injection pulse width Tp is calculated by an expression "$Tp=K\cdot Q/N$" where K is a constant. Furthermore, the running conditions of the engine 1 are detected at step S9 followed by step S10 at which the operation is performed with respect to a correction value C. It is then judged at step S11 whether an idle switch for detecting the full closing of the throttle valve 9 is on or off. If the idle switch is on, it is judged at step S12 whether or not the engine speed N is greater than a predetermined value A. If $N>A$, the engine is judged to be in the deceleration condition. In this case, a deceleration flag $Z_{FC}$ is set to "1" at step S13 followed by step S14 at which the last injection pulse width T is set to "0", on the basis of which the injector 10 is activated. Thereafter, the procedure returns to step S6. In this way, the supply of fuel to the injector 10 is reduced or cut, thereby improving fuel consumption.

On the other hand, if the idle switch is judged to be off at step S11, or if $N\leqq A$ at step S12, the engine is judged not to be in the deceleration condition. In this case, the deceleration flag $Z_{FC}$ is set to "0" at step S16 followed by step S17 at which it is judged whether or not the transmission is in any geared position. If the transmission is not in any geared position, the transmission is judged to be in the neutral position. In this case, the procedure proceeds to step S20 at which the fuel reduction constant $C_{REC}$ is set to "0" so that reduction of fuel at the time of restoration may be stopped for the purpose of preventing the occurrence of stalling of the engine. At subsequent step S23, the last injection pulse width T is calculated by an expression "$T=(1-C_{REC}+C)\cdot Tp$" and outputted at step S15 to activate the injector 10. The procedure then returns to step S6.

Furthermore, if the transmission is in any geared position, i.e. if the judgment at step S17 is YES, it is judged at step S18 whether or not the deceleration flag $Z_{FC}$ has been changed from "1" to "0". If this flag $Z_{FC}$ has been changed from "1" to "0", it is judged that restoration has just occurred. Then, the initial fuel reduction constant $C_{RECO}$ is set as the fuel reduction constant $C_{REC}$ at step S19 followed by step S23 at which the last injection pulse width T is calculated. Based on this value, the injector 10 is activated at step S15 and the procedure returns to step S6. As a result, the amount of fuel to be supplied to the engine 1 at the time of removal of deceleration is rendered to be less by the amount corresponding to the initial fuel reduction constant $C_{RECO}$ than the normal amount of fuel in compliance with the running conditions. Accordingly, a sudden increase of fuel supply caused by restoration at the time of removal of deceleration is restrained, thus preventing the occurrence of torque shock.

As described hereinbefore, since the initial fuel reduction constant $C_{RECOA}$ of the automatic transmission is less than that $C_{RECOM}$ of the manual transmission, the function of preventing torque shock is fully achieved in the manual transmission, whereas stalling the the engine is desirably prevented when the shift lever is shifted from the neutral position to the drive position in the automatic transmission.

When the deceleration flag $Z_{FC}$ has not just been changed from "1" to "0" and the judgment at step S18 is NO, the system judges that the amount of fuel has already been restored to the normal amount. It is then judged at step S21 whether or not the fuel reduction constant $C_{REC}$ is less than or equal to "0". If $C_{REC}>0$ the fuel reduction constant $C_{REC}$ is reduced by the rate $C_{INC}$ of fuel increase at step S22 followed by step S23 at which the last injection pulse width T is calculated. On the basis of the calculated value, the injector 10 is activated at step S15 and the procedure returns to step S6. If $C_{REC}\leqq 0$ after the fuel reduction constant $C_{REC}$ has further been reduced, the judgment at step S21 becomes YES. In that event, the procedure proceeds to step S20 at which the fuel reduction constant $C_{REC}$ is rendered to be "0" so that the normal amount of fuel may be supplied to the engine 1. Thereafter, the procedure proceeds to step S23 at which the last injection pulse width T is calculated. The injector 10 is then activated at step S15 and the procedure returns to step S6. As a result, the amount of fuel to be supplied to the engine 1 at the time of removal of deceleration is gradually restored to the normal amount. Accordingly, a sudden increase of fuel supply caused by restoration at the time of removal of deceleration is restrained, thus preventing the occurrence of torque shock.

In the above-described flow chart, the step S9 constitutes running condition detecting means for detecting the running conditions of the engine 1, whereas other steps except the step S9 constitute fuel cut control means for cutting the fuel supply to the engine 1 at the time of deceleration in response to an output of the running condition detecting means. Furthermore, such fuel cut control means controls the injector 10 which acts as fuel supply means so that the amount of fuel to be supplied to the engine 1 at the time of removal of deceleration may be rendered to be less than the normal amount corresponding to the running conditions of the engine 1.

From the foregoing, the system according to the present invention can prevent not only the occurrence of torque shock at the time of removal of deceleration in an engine equipped with a manual transmission, but also stalling of the engine when the shift lever is shifted from the neutral position to the drive position in an engine equipped with an automatic transmission.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A fuel control system for an automobile engine equipped either with an automatic transmission or a manual transmission, said system comprising:

running condition detecting means for detecting running conditions of the engine;

fuel supply means for supplying fuel to the engine;

fuel cut control means for cutting the amount of fuel to be supplied to the engine in response to an output of said running condition detecting means at a time of deceleration of the engine and for controlling said fuel supply means so that the amount of fuel to be supplied to the engine at a time of removal of such deceleration is less than a normal amount corresponding to the running conditions of the engine;

engine distinguishing means for distinguishing between whether the engine is equipped with an automatic transmission or is equipped with a manual transmission; and control means, operable in response to a signal from said engine distinguishing means, for controlling operation of said fuel cut control means so that the amount of reduction of fuel by said fuel cut control means is less when the engine is equipped with an automatic transmission than when the engine is equipped with a manual transmission.

2. The system according to claim 1, wherein said control means controls operation of said fuel cut control means so that an initial amount of fuel to be supplied to the engine at said time of removal of deceleration is less when the engine is equipped with the manual transmission than when the engine is equipped with the automatic transmission.

3. The system according to claim 1, wherein said control means controls operation of said fuel cut control means so that a rate of increase of fuel up to said normal amount after removal of deceleration is less when the engine is equipped with the manual transmission than when the engine is equipped with the automatic transmission.

4. The system according to claim 2, wherein said control means controls operation of said fuel cut control means so that a rate of increase of fuel up to said normal amount after removal of deceleration is less when the engine is equipped with the manual transmission than when the engine is equipped with the automatic transmission.

5. The system according to claim 1, wherein said running condition detecting means comprises a switch for detecting a full closing of a throttle valve of the engine.

* * * * *